US005232171A

United States Patent [19]

Hensen

[11] Patent Number: 5,232,171

[45] Date of Patent: Aug. 3, 1993

[54] APPARATUS FOR PREPARING A TEXTILE STRAND END HAVING DUAL SUCTION CONDUITS

[75] Inventor: Helmuth Hensen, Monchen-Gladbach, Fed. Rep. of Germany

[73] Assignee: W. Schlafhorst AG & Co., Moenchengladbach, Fed. Rep. of Germany

[21] Appl. No.: 868,027

[22] Filed: Apr. 13, 1992

[30] Foreign Application Priority Data

Dec. 23, 1991 [DE] Fed. Rep. of Germany ..... 9115995

[51] Int. Cl.[5] ..... B65H 54/00

[52] U.S. Cl. ..... 242/18 R; 242/35.6 E

[58] Field of Search ..... 242/18 R, 18 EW, 35.6 E, 242/35.6 R, 35.5 R

[56] References Cited

U.S. PATENT DOCUMENTS

| | | | |
|---|---|---|---|
| 3,295,775 | 1/1967 | Raasch et al. | 242/35.5 R |
| 4,681,271 | 7/1987 | Matsui et al. | 242/18 R |
| 4,909,451 | 3/1990 | Kuepper et al. | 242/18 EW |
| 4,928,903 | 5/1990 | Wirtz et al. | 242/130 |
| 5,083,715 | 1/1992 | Wirtz et al. | 242/18 R |
| 5,104,052 | 4/1992 | Wey et al. | 242/18 R |
| 5,106,027 | 4/1992 | Wirtz et al. | 242/18 R |

*Primary Examiner*—Stanley N. Gilreath

*Attorney, Agent, or Firm*—Shefte, Pinckney & Sawyer

[57] ABSTRACT

A strand end preparation apparatus includes a suction applying housing having a longitudinal suction slot and a pair of suction assemblies, each communicated with the suction applying housing. Each suction assembly includes a suction blocking device for selectively blocking the flow of suction therethrough and a strand end cutting device for selectively cutting a strand end drawn into the suction assembly. In one variation of the strand end preparation apparatus, suction is applied simultaneously through both suction assemblies to draw a strand end off a yarn package through the suction slot and into a respective one of the suction assemblies. The drawn in strand end is then re-wound on the package of textile strand material at a preferred disposition thereon. The strand end preparation apparatus advantageously provides sufficient suction along the entire axial extent of the textile strand material of the package so that a strand end can be reliably drawn off during a strand end disposing operation.

16 Claims, 3 Drawing Sheets

APPARATUS FOR PREPARING A TEXTILE STRAND END HAVING DUAL SUCTION CONDUITS

BACKGROUND OF THE INVENTION

The present invention relates to an apparatus for preparing an end of textile material and, more particularly, to an apparatus having dual suction conduits communicated with a suction applying housing having a suction slot for applying suction along the axial extent of a textile strand material package such as, for example, a yarn package.

In one textile process, a textile strand material such as, for example, yarn, is built onto a tube to form a yarn package. After a package is built, one common further textile processing step involves unwinding of the yarn from the yarn package by a textile winding machine. To facilitate the initial engagement of the yarn on the yarn package by the textile winding machine, it is known to dispose an end of the yarn on the yarn package in a preferred preliminary position on the package at which the yarn end can be readily accessed and engaged by the textile winding machine.

Preferably, a device for disposing a yarn end in a preferred preliminary disposition on the yarn package is capable of drawing off a yarn end from any random position along the yarn package and re-positioning the yarn end at the preferred preliminary disposition without undue disturbance or damage of the outer surface of the yarn package. In U.S. Pat. No. 5,106,027 to Wirtz et al, an apparatus is disclosed for preparing a strand or yarn end of a package of yarn or textile material and includes a suction applying housing having a longitudinal slot. The longitudinal slot is disposed in co-extensive manner with the body of yarn on the yarn package supported at a yarn end preparation location and suction is applied through the suction slot to draw in a yarn end on the yarn package into the suction applying housing. The suction applying housing is communicated at one end with a suction conduit extending to the suction source. Accordingly, the flow of suction through the suction slot is strongest at the one respective end of the suction slot toward the suction conduit and correspondingly diminishes along the suction slot towards its other respective end. In the case in which so-called large yarn packages are to be handled, or in the case in which yarn packages having so-called reserve windings are to be handled, it is especially critical that sufficient suction be applied at the respective end of the suction slot remote from the suction conduit so that, for example, a reserve end winding wound around the exposed bottom portion of the tube of the yarn package, can be reliably removed from the yarn package to foreclose the risk that the reserve end winding will subsequently cause problems during a yarn unwinding operation at the textile winding machine. Accordingly, the need exists for a strand end preparation apparatus which can reliably engage a strand end of textile material of a package at any random location along the entire axial extent of the package.

SUMMARY OF THE INVENTION

Briefly described, the present invention provides an apparatus for drawing off the end of at least one strand of textile material built on a tube to form a package. The apparatus includes means for rotating a package about its axis at a strand end preparation location to selectively permit at least one of the winding and unwinding of a strand end of the package and suction applying housing which has a suction slot through which suction is applied to a package at the strand end preparation location during selective winding and unwinding rotation of the package. Also, the apparatus includes a first suction assembly which has a first suction conduit communicated at one end with a suction source and at its other end with the suction applying housing at a first communication opening thereat, the first suction assembly for applying suction through the suction slot to draw a strand end off a package into the suction slot and along the first suction conduit. Further, the apparatus includes a second suction assembly which has a second suction conduit communicated at one end with a suction source and at its other end with the suction applying housing at a second communication opening thereat spaced from the first communication opening, the second suction assembly for applying suction through the suction slot to draw a strand end off a package into the suction slot and along the second suction conduit.

According to one aspect of the present invention, the suction slot extends parallel to the axis of the package in co-extensive manner with at least the principal axial extent of the textile material of the package. According to another aspect of the present invention, the first communication opening which the first suction assembly communicates with the suction applying housing is disposed adjacent one end of the suction slot and the second communication opening at which the second suction assembly communicates with the suction applying housing is disposed more closely adjacent the other respective end of the suction slot than the first communication opening.

According to yet a further aspect of the present invention, the first and second suction assemblies are operable simultaneously to apply suction through the suction slot.

According to an additional aspect of the present invention, the first suction assembly includes a first suction blocking means for selectively blocking the flow of suction through the first suction assembly and the second suction assembly includes a second suction blocking means for selectively blocking the flow of suction through the second suction assembly. In one feature of the additional aspect of the present invention, the first suction blocking means includes first means for cutting a strand end drawn into the first suction assembly, the first suction blocking means which is movable between a non-blocking position in which the flow of suction is not blocked and a blocking position in which the flow of suction is blocked and the first means for cutting a strand end is movable between a non-cutting position and a cutting position in correspondence with the movement of the first suction blocking means between its non-blocking and blocking positions such that the first strand end cutting means cuts a strand end in correspondence with the blocking of suction by the first suction blocking means.

In another feature of the additional aspect of the present invention, the second suction blocking means includes second means for cutting a strand end drawn into the second suction assembly, the second suction blocking means which is movable between a non-blocking position in which the flow of suction is not blocked and a blocking position in which the flow of suction is blocked and the second means for cutting a strand end which is movable between a non-cutting position and a cutting position in correspondence with the movement of the second suction blocking means between its non-blocking and blocking positions.

According to a further different aspect of the present invention, the first and second suction assemblies are both communicated with a common suction source.

According to yet another additional aspect of the present invention, at least one end of the tube of the package extends axially beyond the textile material of the package and the suction slot is at least partially co-extensive with the portion of the tube extending axially beyond the textile material of the package.

In another feature of the additional aspect of the present invention, there is provided means, disposed intermediate the first communication opening and the first strand end cutting means, for sensing the travel therepast of a strand end. Also, there is provided means for controlling the second suction blocking means to block the flow of suction through the second suction assembly and for controlling the second strand end cutting means to move from its non-cutting position to its cutting position while the first suction blocking means is in its non-blocking position, whereby a strand end previously drawn into the second suction assembly is thereafter drawn out of the second suction assembly by the flow of suction through the first suction assembly after the flow of suction through the second suction assembly has been blocked by the second suction blocking means and the strand end sensing means signals the controlling means to move the first suction blocking means from its non-blocking position to its blocking position in response to the sensing of the travel of the strand end by the strand end sensing means.

Preferably, the controlling means includes means for controlling the package rotating means to rotate the package in a winding direction in response to sensing by the strand end sensing means of the travel of a strand end therepast. Also, the controlling means preferably includes means for controlling the first suction blocking means to move from its blocking position to its non-blocking position during rotation of the package in the winding direction to permit the flow of suction through the first suction assembly to produce corresponding tension on the strand end by the flow of suction as the strand end is re-wound on the package due to the winding rotation of the package by the package rotating means.

According to yet a further additional aspect of the present invention, one end of the textile strand material of the package is wound in a reserve winding in which the strand end is wound on the tube of the package in a winding direction opposite to the winding direction of the textile strand material on the package and the apparatus also includes means for controlling the package rotating means to rotate the package in the direction of winding of the reserve winding strand end.

DETAILED DESCRIPTION OF THE PREFERRED EMBODIMENTS

Figure 1:
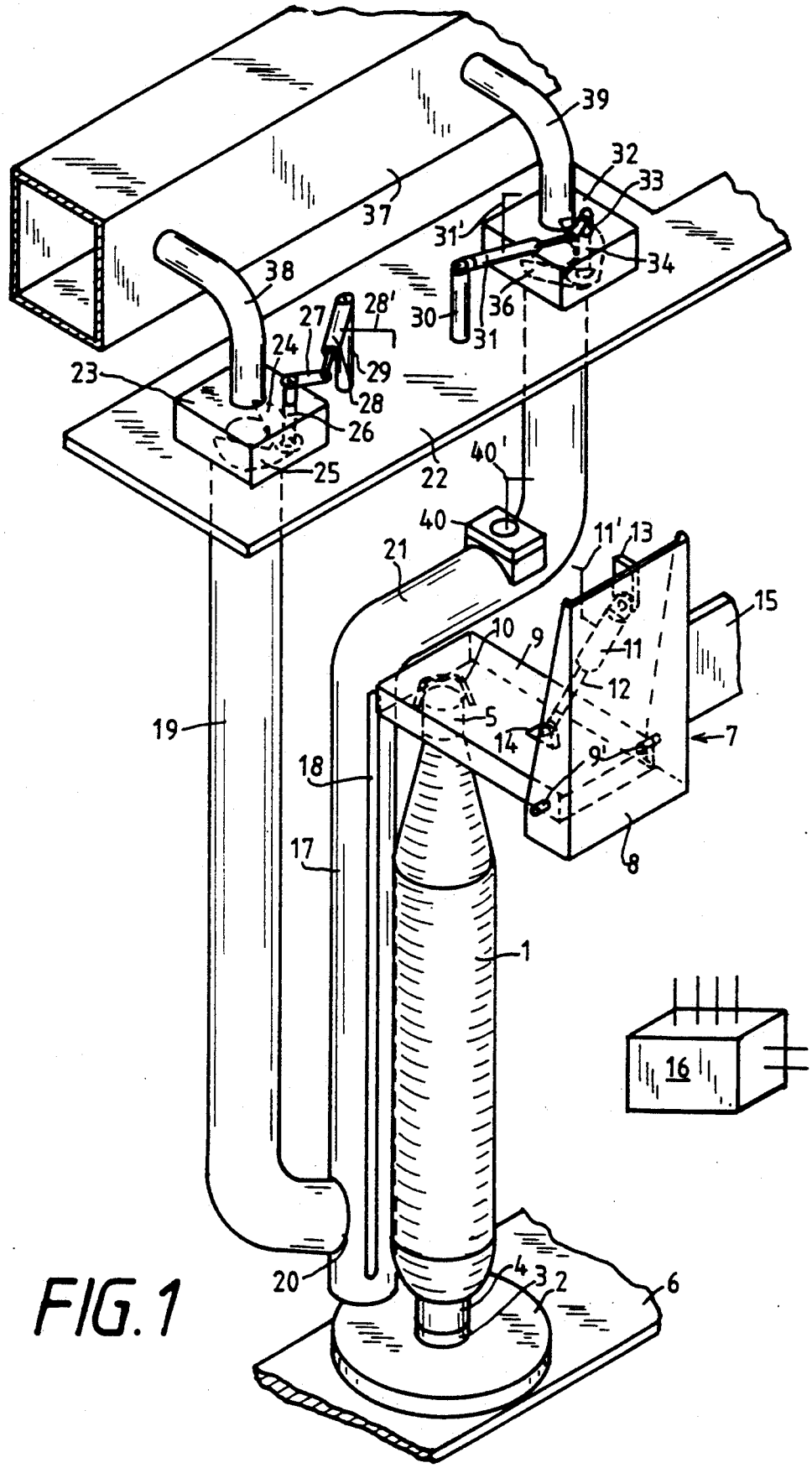
FIG. 1 is a perspective view of one embodiment of the strand end preparation apparatus of the present invention.

A conventional yarn package transport assembly transports a plurality of yarn packages 1, each individually supported on a conventional package caddy 2, to a location for handling the yarn or textile material built on each yarn package 1. For example, the yarn transport assembly may transport the supported yarn packages 1 to a conventional winding machine (not shown) for unwinding of the yarn of each yarn package 1 thereat.

Each yarn package 1 is formed of a strand of textile material built on a cylindrical tube and the bottom or lower portion 4 of the tube is adapted to be inserted over a cylindrical peg 3 of a caddy 2 of support of the yarn package 1 in individual upright disposition on the caddy 2. A strand end preparation apparatus is provided by the present invention which is particularly suitable for preparing yarn packages which are subsequently handled by devices of the type which direct tangential streams of air against the yarn package to effect further dislodgement of the strand end. Additionally, the strand end preparation apparatus is particularly adapted for handling so-called "great" or "large" yarn packages which typically have a total yarn length of approximately 350–600 millimeters, resulting in a larger package than even so-called cross-wound packages.

Figure 3:
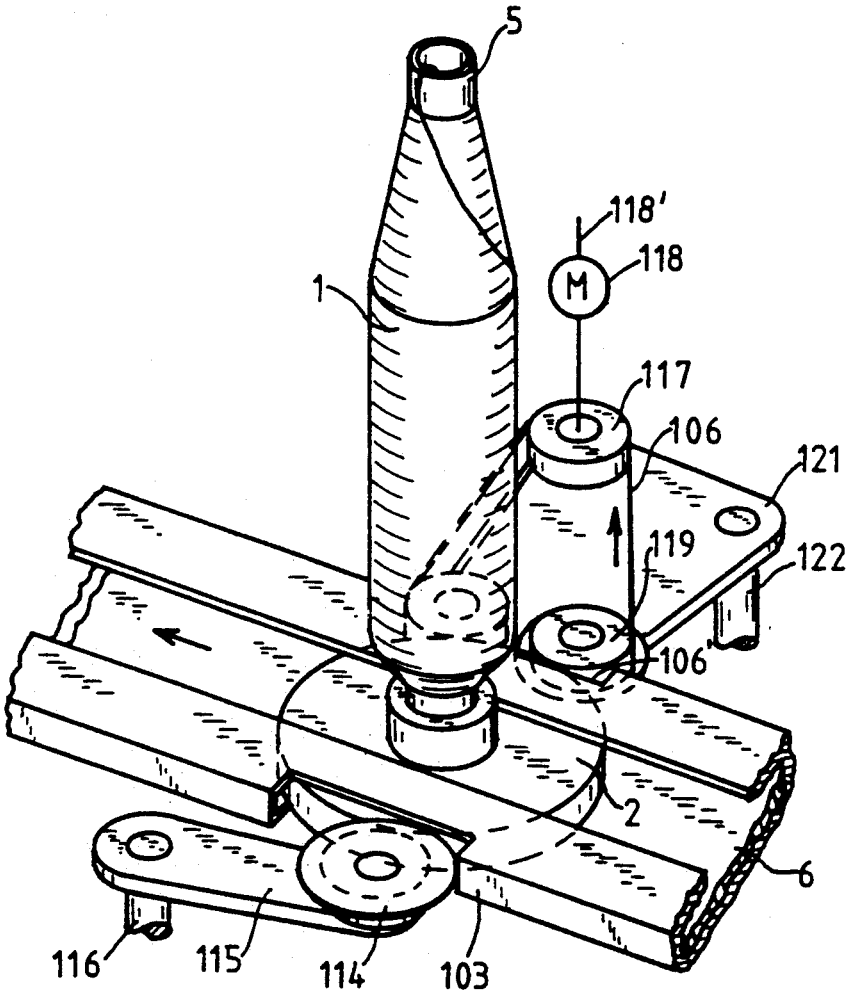
FIG. 3 is a perspective view of the package rotation component of the strand end preparation apparatus of the present invention.

As seen in FIG. 3, the strand end preparation apparatus includes a package rotation component for rotating a yarn package 1 about its axis during at least the unwinding of a strand end therefrom and comprising a conventional mechanism such as, for example, a press roller 114 rotatably mounted to one free end of a pivot arm 115 and a pair of rotation rollers mounted to a second pivot plate such as is illustrated and described in U.S. Pat. No. 5,083,715 and U.S. Pat. No. 5,106,027, both to Wirtz et al, which are hereby incorporated by reference herein. A pivot shaft 116 is fixedly mounted to the other free end of the pivot arm 115 and is operatively interconnected to a conventional pivot drive device (not shown) for pivoting movement of the pivot arm 115 about the axis of the pivot shaft 116 which can be, for example, in the form of a conventional cam-type drive or solenoid mechanism. The press roller 114 is freely rotatable and its circumferential surface is generally axially aligned with the circumferential surface of the annular base portion of the respective package caddy 2 for rolling engagement therealong.

The package rotation component additionally includes a pair of rotation rollers 119 (one being shown in solid lines and the other in broken lines) mounted to a pivot plate 121. The pivot plate 121 has four sides with the pair of the rotation rollers 119 being mounted on a common side thereof. A pivot shaft 122 is fixedly mounted to the pivot plate 121 adjacent a corner remote from the rotation rollers 119 and a drive roller 117 is pivotally mounted to the pivot plate 121 at another corner of the pivot plate 121.

The drive roller 117 is operatively connected to the drive shaft of a conventional drive motor 118 for driving rotation of the drive roller 117. An endless member or drive belt 106 which can be in the form, for example, of a conventional elastomeric belt, is trained around the drive roller 117 and the rotation rollers 119 for driving movement in correspondence with the driving rotation of the drive roller 117 by the drive motor 118 which is operatively connected to a control unit 16 by a connector 118.

A guide channel 103 is provided with an opening for permitting direct engagement of the drive belt 106 with the circumferential surface of the annular base portion of the respective package caddy 2 at the strand end preparation location. The pivot shaft 122 is operatively interconnected to the conventional pivot drive mechanism to which the pivot shaft 116 is interconnected for pivoting movement of the pivot plate 121 about the axis of the pivot shaft 122 between a disengaged position in which the drive belt 106 is disposed out of interference with the package caddies 2 being transported by the yarn package transport assembly 1 and an engaged position in which the drive belt 106 is in engagement with the respective package caddy 2 at the strand end preparation location.

The strand end preparation apparatus also includes a strand end engaging device for engaging an end of a strand of textile material on a yarn package 1 supported at the strand end preparation location. The strand end engaging device includes a means for supporting the end of the textile strand material during unwinding which is preferably in the form of a suction applying housing 17 having a slot 18 formed therein for applying suction created by the suction source to a yarn package 1 supported at the strand end preparation location. The strand end engaging device is operatively connected to a lower conduit 19 at a first communication opening 20 thereat and is operatively connected to an upper conduit 21 at a second communication opening thereat. The suction applying housing 17 has a tubular portion of a uniform transverse cross-section. The lower conduit 19 is part of a lower suction assembly and the upper conduit 21 is part of an upper suction assembly. Conduits 19,21 are communicated via tubes 38,39 to a common suction duct 37 of a conventional suction source (not shown).

The slot 18 is in the form of a longitudinal slot aligned with the axis of the tubular portion of the suction applying housing 17 and the tubular portion is supported such that its axis is generally parallel with the axis of a yarn package 1 supported at the strand end preparation location. The longitudinal extent of the slot 18 generally corresponds to the axial length of the tube of a yarn package 1 such that the upper end of the slot 18 extends axially beyond the upper end of the tube and the lower end of the slot 18 extends at least to the lower windings of the yarn package 1.

The strand end preparation apparatus also includes a sensing means 40 for sensing the presence of an unwound strand end at a sensing location in the upper suction conduit 21. The sensing means 40 is in the form of a light source for emitting light and a photodiode. The light source is mounted to the conduit 21 for emitting a beam of light at an angle relative to the direction of unwinding travel of a strand end in the conduit 21. The photodiode is operatively connected via a connector 40' to the control unit 16 and is mounted to the conduit 21 at a location for sensing the light beam emitted by the light source and transmitting a signal via the connector 40' to the control unit 16 in response to an interruption in the light beam caused by the travel therethrough of an unwound strand end. The sensing location is located downstream of the strand end engaging location relative to the direction of unwinding travel of the unwound strand end in the conduit 21.

Each of the upper and lower suction assemblies includes a strand cutting means for cutting a strand end supported in the conduits 19,21 at a cutting location intermediate the slot 18 and the suction duct 37. The cutting means is in the form of a cutter 23,32 having a fixed cutting jaw 24,33 and a movable cutting jaw 25,36 movable relative to the fixed cutting jaw 24,33 between a disengaged position out of engagement with an unwound strand end supported in the conduits 19,21 and an engaged position in which the cutting jaws cut the unwound strand end. The movable cutting jaw 25,36 is fixedly mounted to a pivot shaft 26,34 which is freely rotatably supported by a cutter housing.

One end of the pivot shaft 26,34 extends outwardly of the cutter housing and is fixedly mounted to one end of a pivot arm 27. The other end of the pivot arm 27 is pivotally connected to the free end portion of a piston of a pneumatic cylinder and piston assembly 28,31 operatively connected to a conventional pneumatic fluid source (not shown) which is operatively connected to the control unit 16. The cylinder and piston assembly 28,31 of each upper and lower suction assembly is mounted on a frame 22 by a support 29,30, respectively.

Each of the cutting jaws 24, 25, 33, and 36 is formed with a semi-cylindrical profile generally corresponding to the transverse cross-section of the conduits 19,21 at the strand cutting location. The semi-cylindrical profiles of each of the cutting jaws 24, 33 and 25, 36 of the pair of cutting jaws substantially completely block the conduits 19,21 when the cutting jaw is in its strand engaging position to thereby restrict the flow of air therepast. The restriction of the flow of air past the strand cutting location substantially stops the suction applied through the respective upper suction conduit 21 or lower suction conduit 19.

The strand and preparation apparatus also includes an assembly for preventing tilting of a yarn package 1 during winding and unwinding of yarn therefrom by the strand end preparation apparatus. The tilt preventing assembly includes a home plate 8 supported by a support 15 on the frame of the textile machine and a pivot plate 9 pivotally connected to the home plate 8 via a pair of pivot bolts 9'. An open, frusto-conical tube top engaging member 10 is secured at its closed end to the pivot plate 9 and has a minor diameter slightly less than the diameter of a tube of a yarn package 1 and a major diameter slightly larger than the diameter of the tube such that the tube top engaging member 10 compressively engages an exposed tube top 5 upon pivoting of the pivot plate 9 to bring the tube top engaging member 10 into engagement with the tube top.

The tilt-preventing assembly 7 includes a cylinder and piston assembly 11 operatively connected to the control unit 16 by a connector 11' with the closed end of the cylinder of the cylinder and piston assembly being pivotally mounted by a mounting flange 13 to the home plate 8 and the free end of the piston of the cylinder and piston assembly being pivotally connected by a mounting flange 14 to the pivot plate 9. The cylinder and piston assembly 11 is operable to selectively pivot the pivot plate 9 forward and way from the home plate 8 to thereby selectively move the tube top engaging member 10 into and out of engagement with an exposed tube top of a yarn package 1 supported for unwinding adjacent the strand end preparation apparatus. The tilt-preventing assembly 7 insures that the respective yarn package 1 being handled by the strand end apparatus remains in a stable disposition with its axis parallel to the suction slot 18 to thereby minimize or completely reduce the risk the upper conically tapering portion of the yarn package 1 is drawn into engagement against the housing 17 due to the suction applied through the suction slot 18.

The operation of the strand end preparation apparatus is as follows. Prior to the transport of a yarn package 1 into an unwinding position adjacent the strand end preparation apparatus, the pivot plate 9 of the tilt preventing assembly 7 is normally in a retracted position in which it does not prevent movement of a yarn package into the yarn unwinding position. In correspondence with the movement of a yarn package 1 into a yarn unwinding position adjacent the strand end preparation apparatus, the control unit 16 controls the cylinder and piston assembly 11 via the connector 11' to pivot the pivot plate 9 outwardly from the home plate 8, whereby the tube top engaging member 10 is lowered into compressive engagement with the top of the tube of the respective yarn package.

Also, in response to movement of the yarn package 1 into the yarn unwinding position, the control unit 16, which is operatively connected to the conventional pivot drive means for driving the pivot shafts 116,122 of the package rotation component, controls the pivot drive means to maintain the press roller 114 and the rotation rollers 119 in their normally disengaged positions. As each package caddy 2 is transported by the belt 6 in the direction shown by the arrow in the drawings, a conventional sensor (not shown) disposed upstream of the strand end preparation location senses the travel therepast of each respective package caddy 2 and transmits this information to the control unit 16. The control unit 16 controls the pivot drive mechanism in response to the receipt of a signal from the package support member sensor to effect pivoting of the press roller 114 and the rotation rollers 119 to their respective package support member engaging positions in correspondence with the arrival of the sensed package caddy 2 at the strand end preparation location.

The press roller 114 is moved by the pivoting action of the pivot arm 115 to engage the respective package caddy 2 while the rotation rollers 119 are moved into the opening 106' by the pivoting of the pivot plate 121 to engage the respective package caddy 2 at two other circumferentially spaced locations thereon. The three circumferentially spaced locations at which the press roller 114 and the rotation rollers 119 engage the respective package caddy 2 define a triangle and this three-point manner of engagement acts to retain the engaged package caddy 2 at a location adjacent the strand end preparation apparatus at which the slot 18 can apply a suction to the yarn package 1 supported on the package caddy 2.

Following the engagement of the respective package support member by the press roller 114 and the rotation rollers 119, the control unit 16 controls the drive motor 118 via the connector 118' to effect driving of the drive belt 106. The control unit 16 can be configured, for example, to respond from a signal from the pivot drive mechanism indicating that the press roller 114 and the rotation rollers 119 have been pivoted to their engaged positions or, alternatively, the control unit 16 can be configured to actuate the driving of the drive belt 106 after the lapse of a predetermined period of time following the receipt of a signal from the package support member sensor. As the belt 106 moves between the rotation rollers 119 in the direction shown by the arrow in the drawing, the drive belt 106 engages the circumferential surface of the annular base portion of the package support member and effects corresponding rotation of the package support member while the package support member continues to be maintained at the strand end preparation location by the action of the press roller 114 and the rotation rollers 119.

The yarn package 1 rotates in correspondence with the rotation of the package caddy 2 in an unwinding direction. In correspondence with the rotation of the yarn package 1, the control unit 16 controls the cylinder and piston assembly 28,31 via the connector 28',31', respectively, to extend (or retract, as appropriate) the pivot arm 27 to thereby move the movable cutting jaw 25,36 to a position in which the cutting edge of the movable cutting jaw is displaced from the cutting edge of the fixed cutting jaw 24,33—i.e., a displaced position in which the flow of suction past the cutter 23,32 is not blocked.

The cylinder and piston assembly 28,31 preferably includes a conventional valve element on its cylinder such as, for example, a three-way valve element for controlling the flow of pressurized fluid into and from the cylinder and piston assembly.

Suction is applied to the yarn package 1 at the yarn unwinding position through the suction slot 18 due to the flow of suction through the conduits 19,21. Due to the dual suction supply arrangement to the housing 17 by the upper and lower suction assemblies, sufficient suction is generated through the two respective ends of the suction slot 18, as well as through the body of the suction slot, to engage a strand end disposed at the upper conically tapering portion of the body of yarn, the middle, generally cylindrical portion of the body of yarn, or the lower conically tapering bottom portion of the body of yarn of the yarn package 1. Typically, a greater degree of suction is required to effect loosening and engagement of a strand end disposed at the upper or lower conically tapering portions of the yarn package 1 as compared with the suction required to loosen and engage a strand end disposed at the middle, generally cylindrical portion of the yarn package. However, due to the application of the dual flows of suction to the suction slot 18 by the upper and lower suction assemblies, it has been found that sufficient suction action can be generated to reliably loosen and engage a strand end at any axial position on a yarn package 1.

After the expiration of a predetermined period of time, the control unit 16 initially controls the cylinder and piston assembly 28 to effect movement of the movable cutting jaw 25 into cutting disposition with the fixed cutting jaw 24 to simultaneously cut any strand end which has been drawn into the conduit 19 and block the flow of further suction along the conduit 19. In correspondence with the stopping of the flow of suction through the conduit 19 of the lower suction assembly, the control unit 16 controls the drive motor 118 to cease rotation of the yarn package 1 in an unwinding direction.

The flow of suction continues through the conduit 21 after the flow of suction through the conduit 19 has been blocked whereupon a cut strand end which may be disposed in the conduit 19 of the lower suction assembly is drawn through the housing 17 into the conduit 21 of the upper suction assembly and past the sensor 40 to thereby interrupt the flow of light emitted by the photodiode of the sensor, whereupon the sensor 40 transmits a signal via the connector 40' to the control unit 16. In response to the signal from the sensor 40, the control unit 16 controls the cylinder and piston assembly 31 to move the movable cutting jaw 33 toward the fixed cutting jaw 36 to effect blocking of the flow of suction through the conduit 21 and, simultaneously, to cut the strand end which has been drawn into the conduit 21.

In correspondence with the cutting of the drawn in strand end by the cutter 32 and the simultaneous closure of the flow of suction through the conduit 21, the control unit 16 controls the drive motor 118 to effect driving rotation of the yarn package 1 in a winding direction, whereupon the strand end disposed in the conduit 21 is wound onto the yarn package 1 or, alternatively, to activate a conventional device (not shown) for disposing the cut strand end in the top of the yarn package tube. Depending upon the position of the upper end of the suction slot 18 relative to the yarn package 1, the strand end re-wound on the yarn package 1 may be re-wound on the exposed tube top 5 of the tube of the yarn package in a relatively loose so-called overwinding for reliable and rapid subsequent removal at the winding station of a textile winding machine.

To facilitate the re-winding of the strand end from the conduit 21 onto the yarn package 1, the cylinder and piston assembly 31 can be controlled to move the movable cutting jaw 33 to a displaced position from the fixed cutting jaw 36, whereupon the flow of suction through the suction conduit 21 will again resume following cutting of the strand end by the cutter 32. The renewed flow of suction through the conduit 21 places the strand end in tension to a limited degree during its rewinding onto the yarn package 1, thereby facilitating the reliable rewinding of the strand end.

In the event that a strand end has been drawn into the conduit 21 of the upper suction assembly during the initial rotation of the yarn package 1 in an unwinding direction, as opposed to being drawn into the conduit 19 of the lower suction assembly, the sensor 40 senses the travel therepast of the drawn in strand end and signals the control unit 16. The control unit 16, which has not to this point in time ceased the flow of suction through the conduit 19 of the lower suction assembly or the conduit 21 of the upper suction assembly, is configured to simultaneously effect movement of the movable cutting jaw 24,33 toward the fixed cutting jaw 25,36, respectively, to thereby effect cutting of the drawn in strand end by the cutter 32 in the upper suction assembly as well as to simultaneously block the flow of suction through both the upper and lower suction assemblies. Thereafter, the now-cut strand end disposed in the conduit 21 of the upper suction assembly is re-wound onto the yarn package 1 in the manner previously described.

In correspondence with the completion of the rewinding of a strand end onto the yarn package 1, the control unit 16 controls the cylinder and piston assembly 11 to retract the pivot plate 9 toward the home plate 8, whereupon the tube top engaging member 10 is moved out of compressive engagement with the tube top 5 of the tube of the yarn package. In correspondence with the release of the tube top 5 by the tube top engaging member 10, the control unit 16 controls the pivot plates 115,121 to release the yarn package 1 from the yarn unwinding position adjacent the strand end preparation apparatus for further transport by the belt 6.

Figure 2:
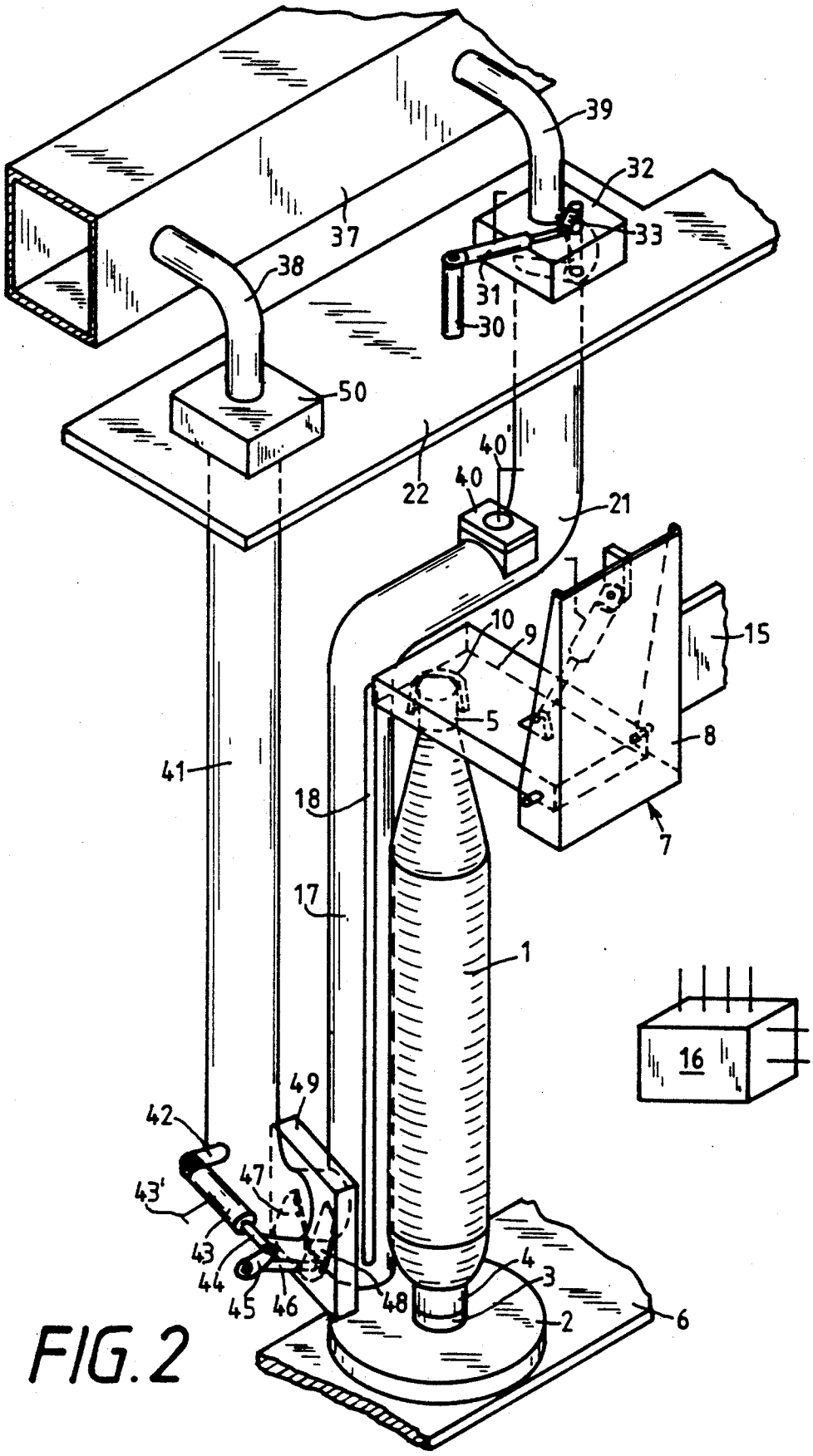
FIG. 2 is a perspective view of another embodiment of the strand end preparation apparatus of the present invention.

In FIG. 2, another embodiment of the strand end preparation apparatus of the present invention is illustrated. In this embodiment, the strand end preparation apparatus is essentially identical in structure and operation to the embodiment of the strand end preparation apparatus illustrated and described with respect to FIG. 1, except that the cutter 23 is deleted and, instead, a cutter 49 is disposed adjacent the end portion of a conduit 41 of the lower suction assembly in communication with the housing 17. The cutter 49 includes a fixed cutting jaw 48 and movable cutting jaw 47, which is pivotally mounted by a pivot 46 for movement between a cutting position in which it is moved toward the fixed cutting jaw 47 for cutting a strand end disposed therebetween and a non-cutting position in which it is displaced from the fixed cutting jaw 47 for permitting the flow of suction past the cutter 49. A lever 45 is fixedly mounted to the pivot 46, which is pivotally mounted to a frame of the textile machine, and one end of the lever 45 is pivotally connected to the free end of a piston 44 of a cylinder and piston assembly 43. The cylinder and piston assembly 43 is connected via a connector 43' to the control unit 16 and is mounted to the conduit 41 of the lower suction assembly by a support 42.

The lower suction assembly can also include a cutter housing 50 for disposition of a cutter therein at the same location as the cutter 23 described with respect to the embodiment illustrated in FIG. 1.

The embodiment of the strand end preparation apparatus illustrated in FIG. 2 is particularly adapted for loosening and engaging a strand end on a yarn package having a so-called reserve winding. A reserve winding is typically formed on a yarn package at the completion of the building of the package at the spinning station of a ring spinning machine and is formed by the relatively rapid downward movement of the ring rail of the ring spinning machine toward the end of the yarn package building operation.

The separate portion of the cut reserve winding which is wound around the upper tapering portion of the yarn package 1 is the portion of the reserve winding which is later engaged to draw off the yarn from the yarn package whereas, on the other hand, the reserve winding end piece or foot winding is not subsequently needed for unwinding of the yarn of the yarn package. However, it is a benefit to remove the cut reserved winding end piece or foot winding so that it cannot cause subsequent problems such as, for example, interference with a subsequent yarn unwinding process. To facilitate subsequent engagement of the reserve winding, one common practice is to wind the end portion of the reserve winding on the exposed bottom portion of the tube of the yarn package, thereby forming a reserve winding end piece or foot winding. In the operation of the embodiment of the strand end preparation apparatus illustrated in FIG. 2, after a yarn package 1 has been positioned at the yarn unwinding position adjacent the strand end preparation apparatus, a conventional device for cutting a reserve winding at a location thereon intermediate its end piece or foot winding and the balance of the reserve winding is actuated to cut the reserve winding on the yarn package 1. For example, a conventional blade member such as illustrated and described in U.S. Pat. No. 5,083,715 to Wirtz et al can be supported adjacent the yarn end preparation location for movement into cutting engagement with a reserve winding of a yarn package 1.

The cutting of the reserve winding results in a separate reserve winding end piece or foot winding which is wound about the bottom portion 4 of the tube of the yarn package 1 in a direction opposite to the winding direction of the other now-separate portion of the reserve winding, which extends in a loose, spiralled manner about the body of the yarn of the yarn package 1 toward the upward tapering portion of the yarn package.

The control unit 16 controls the drive motor 118 to rotate the yarn package 1 in the winding direction in correspondence with the cutting of the reserve winding by the conventional reserve winding cutting device. Also, the control unit 16 controls the cylinder and piston assembly 43 to extend (or retract, as appropriate) the lever 45 to thereby effect movement of the movable cutting jaw 48 away from the fixed cutting jaw 47. Normally, the cutting jaw 48 of the lower suction assembly and the movable cutting jaw of the cutter 32 of the upper suction assembly are in a closed, cutting disposition at the time of arrival of a yarn package 1 into the yarn end preparation location so that there is no suction flow through either the conduit 21 or the conduit 41. In correspondence with the movement of the movable cutting jaw 48 of the lower suction assembly to its non-cutting position, suction is applied through the suction slot 18 (in particular at its lower end adjacent the exit opening of the conduit 41), whereupon the reserve end winding piece or foot winding on the bottom portion 4 of the tube of the yarn package 1 is drawn into the suction slot 18 and thereafter into the conduit 41 of the lower suction assembly. The suction applied through the suction slot 18 may engage and draw in the other portion of the cut reserve winding extending about the upper tapering portion of the yarn package 1. However, since the yarn package 1 is rotated in the winding direction during this suction applying operation, any portion of the reserve end winding drawn in in this manner is immediately drawn out of the suction slot 18 and re-wound again onto the yarn package 1.

After the yarn package 1 has been rotated in the winding direction for a predetermined period of time, the control unit 16 controls the cylinder and piston assembly 43 to move the movable cutting jaw 48 toward the fixed cutting jaw 47 to effect cutting of the drawn in reserve winding end piece or foot winding. Alternatively, a conventional sensor can be disposed in operative connection with the lower suction assembly for detecting that a reserve winding end piece or foot winding has been drawn into the lower suction assembly and, in response to a signal from such a sensor, the control unit 16 can be configured to actuate the cylinder and piston assembly 43 for cutting of the drawn in strand end. Also, the control unit 16 can be configured to control the cutter 49 to repeat the application of suction through the suction slot 18 for one or several additional cycles to thereby insure that a reserve winding end piece or foot winding is removed from the tube of the yarn package 1.

In correspondence with the cutting of a reserve winding end piece or foot winding drawn into the lower suction assembly, the control unit 16 controls the movable cutting jaw of the cutter 32 of the upper suction assembly to move to a displaced position in which a flow of suction through the conduit 21 is permitted and, simultaneously, the direction of rotation of the yarn package 1 is reversed from a winding direction to an unwinding direction as suction is applied to through the suction slot 18 to loosen and engage the portion of the reserve winding extending about the upper tapering portion of the yarn package 1. The drawing in and cutting of the other portion of the reserve winding then follows in the same manner as described above with respect to the embodiment illustrated in FIG. 1.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for drawing off the end of at least one strand of textile material built on a tube to form a package, comprising:

means for rotating a package about its axis at a strand end preparation location to selectively permit at least one of the winding and unwinding of a strand end of the package;

a suction applying housing having a suction slot through which suction is applied to a package at the strand end preparation location during the selected one of the winding and unwinding rotation of the package;

a first suction assembly having a first suction conduit communicated at one end with a suction source and at its other end with the suction applying housing at a first communication opening thereat, the first suction assembly for applying suction through the suction slot to draw a strand end off a package into the suction slot and along the first suction conduit; and a second suction assembly having a second suction conduit communicated at one end with a suction source and at its other end with the suction applying housing at a second communication opening thereat spaced from the first communication opening, the second suction assembly for applying suction through the suction slot to draw a strand end off a package into the suction slot and along the second suction conduit.

2. An apparatus for drawing off the end of at least one strand of textile material according to claim 1 wherein the suction slot extends parallel to the axis of the package in co-extensive manner with at least the principal axial extent of the textile material of the package.

3. An apparatus for drawing off the end of at least one strand of textile material according to claim 2 wherein the first communication opening which the first suction assembly communicates with the suction applying housing is disposed adjacent one end of the suction slot and the second communication opening at which the second suction assembly communicates with the suction applying housing is disposed more closely adjacent the other respective end of the suction slot than the first communication opening.

4. An apparatus for drawing off the end of at least one strand of textile material according to claim 2 wherein at least one end of the tube of the package extends axially beyond the textile material of the package and the suction slot is at least partially co-extensive with the portion of the tube extending axially beyond the textile material of the package.

5. An apparatus for drawing off the end of at least one strand of textile material according to claim 1 wherein the first and second suction assemblies are operable simultaneously to apply suction through the suction slot.

6. An apparatus for drawing off the end of at least one strand of textile material according to claim 1 wherein the first suction assembly includes a first suction blocking means for selectively blocking the flow of suction through the first suction assembly and the second suction assembly includes a second suction blocking means for selectively blocking the flow of suction through the second suction assembly.

7. An apparatus for drawing off the end of at least one strand of textile material according to claim 6 wherein the first suction blocking means includes first means for cutting a strand end drawn into the first suction assembly, the first suction blocking means being movable between a non-blocking position in which the flow of suction is not blocked and a blocking position in which the flow of suction is blocked and the first means for cutting a strand end is movable between a non-cutting position and a cutting position in correspondence with the movement of the first suction blocking means between its non-blocking and blocking positions such that the first strand end cutting means cuts a strand end in correspondence with the blocking of suction by the first suction blocking means.

8. An apparatus for drawing off the end of at least one strand of textile material according to claim 6 wherein the second suction blocking means includes second means for cutting a strand end drawn into the second suction assembly, the second suction blocking means being movable between a non-blocking position in which the flow of suction is not blocked and a blocking position in which the flow of suction is blocked and the second means for cutting a strand end being movable between a non-cutting position and a cutting position in correspondence with the movement of the second suction blocking means between its non-blocking and blocking positions.

9. An apparatus for drawing off the end of at least on strand of textile material according to claim 8 and further comprising means, disposed intermediate the first communication opening and the first strand end cutting means, for sensing the travel therepast of a strand end.

10. An apparatus for drawing off the end of at least one strand of textile material according to claim 9 and further comprising means for controlling the second suction blocking means to block the flow of suction through the second suction assembly and for controlling the second strand end cutting means to move from its non-cutting position to its cutting position while the first suction blocking means is in its non-blocking position, whereby a strand end previously drawn into the second suction assembly is thereafter drawn out of the second suction assembly by the flow of suction through the first suction assembly after the flow of suction through the second suction assembly has been blocked by the second suction blocking means and the strand end sensing means signals the controlling means to move the first suction blocking means from its non-blocking position to its blocking position in response to the sensing of the travel of the strand end by the strand end sensing means.

11. An apparatus for drawing off the end of at least one strand of textile material according to claim 10 wherein the controlling means includes means for controlling the package rotating means to rotate the package in a winding direction in response to sensing by the strand end sensing means of the travel of a strand end therepast.

12. An apparatus for drawing off the end of at least one strand of textile material according to claim 10 wherein the controlling means includes means for controlling the first suction blocking means to move from its blocking position to its non-blocking position during rotation of the package in the winding direction to permit the flow of suction through the first suction assembly to produce corresponding tension on the strand end by the flow of suction as the strand end is re-wound on the package due to the winding rotation of the package by the package rotating means.

13. An apparatus for drawing off the end of at least one strand of textile material according to claim 8 wherein the second suction blocking means is disposed relatively closely adjacent the second communication opening.

14. An apparatus for drawing off the end of at least one strand of textile material according to claim 1 wherein the first and second suction assemblies are both communicated with a common suction source.

15. An apparatus for drawing off the end of at least one strand of textile material according to claim 1 wherein one end of the textile strand material of the package is wound in a reserve winding in which the strand end is wound on the tube of the package in a winding direction opposite to the winding direction of the textile strand material on the package and further comprising means for controlling the package rotating means to rotate the package in the direction of winding of the reserve winding strand end.

16. An apparatus for drawing off the end of at least one strand of textile material built on a tube to form a package, the package being of the type having a relatively large body of textile material formed of a length of textile material substantially longer than a standard length of textile material, comprising:

means for rotating a package about its axis at a strand end preparation location to selectively permit at least one of the winding and unwinding of a strand end of the package;

a suction applying housing having a suction slot through which suction is applied to a package at the strand end preparation location during the selected one of a winding and unwinding rotation of the package;

a first suction assembly having a first suction conduit communicated at one end with a suction source and at its other end with the suction applying housing at a first communication opening thereat, the first suction assembly for applying suction through the suction slot to draw a strand end off a package into the suction slot and along the first suction conduit; and a second suction assembly having a second suction conduit communicated at one end with a suction source and at its other end with the suction applying housing at a second communication opening thereat spaced from the first communication opening, the second suction assembly for applying suction through the suction slot to draw a strand end off a package into the suction slot and along the second suction conduit.

* * * * *